United States Patent [19]

Tomsa

[11] Patent Number: 4,534,607

[45] Date of Patent: Aug. 13, 1985

[54] CONNECTOR ASSEMBLY AND COUPLING RING

[75] Inventor: Vladimir Tomsa, Chicago, Ill.

[73] Assignee: Allied Corporation, Morristown, N.J.

[21] Appl. No.: 616,873

[22] Filed: Jun. 4, 1984

[51] Int. Cl.[3] ..... H01R 13/623

[52] U.S. Cl. ..... 339/89 R; 339/113 R; 339/DIG. 2

[58] Field of Search ..... 339/89 R, 89 C, 89 M, 339/90 R, 90 C, DIG. 2, 113 R; 285/82, 89

[56] References Cited

U.S. PATENT DOCUMENTS

| | | | |
|---|---|---|---|
| 3,097,905 | 7/1963 | Shearer | 339/186 |
| 3,115,380 | 12/1963 | Kuehl et al. | 339/89 M |
| 3,165,340 | 1/1965 | Kuehl et al. | 339/89 M |
| 3,552,777 | 1/1971 | Heinrich et al. | 339/89 R |
| 3,772,635 | 11/1973 | Frey et al. | 339/99 R |
| 3,960,428 | 6/1976 | Naus et al. | 339/90 R |
| 4,066,315 | 1/1978 | Arneson | 339/89 M |
| 4,090,761 | 5/1978 | Souville et al. | 339/90 R |
| 4,108,522 | 8/1978 | Favale | 339/19 |
| 4,109,990 | 8/1978 | Waldron et al. | 339/89 M |
| 4,239,315 | 12/1980 | Lacaze, Jr. | 339/89 M |
| 4,268,103 | 5/1981 | Schildkraut et al. | 339/89 M |
| 4,277,125 | 7/1981 | Ball | 339/113 |
| 4,289,368 | 9/1981 | Schildkraut | 339/89 M |
| 4,290,662 | 9/1981 | Storcel | 339/89 M |
| 4,322,121 | 3/1982 | Riches et al. | 339/89 M |
| 4,373,770 | 2/1983 | Raux et al. | 339/113 R |

*Primary Examiner*—John McQuade

*Attorney, Agent, or Firm*—C. D. Lacina

[57] ABSTRACT

A two-part electrical connector assembly (10, 20) includes a coupling member (30) rotatably carried by one connector part for engaging the other connector part and is characterized by a cylindrical cup-shaped detent sleeve (44) carried by the one part (10) and coupled to said coupling member, normally inoperative ratchet means (56, 70) engageable between the one part and the detent sleeve for resisting rotation of the coupling member, the ratchet means being adapted to become operable only when the two parts approach a fully mated condition by rotation of the coupling member in a mating direction, and indicating means (60, 40) including an indicator member (64) associated with the ratchet means for indicating the position of the connector parts, the indicating means initially providing a tactile and audible indication that the parts are approaching the mated condition and the indicator member providing a visual indication that the fully mated condition has finally been achieved.

11 Claims, 13 Drawing Figures

FIG. 3
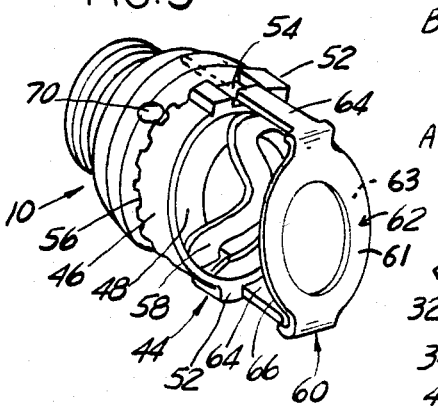
FIG. 12
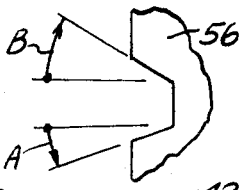
FIG. 13
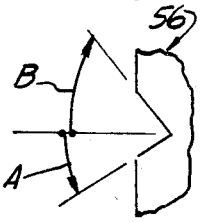
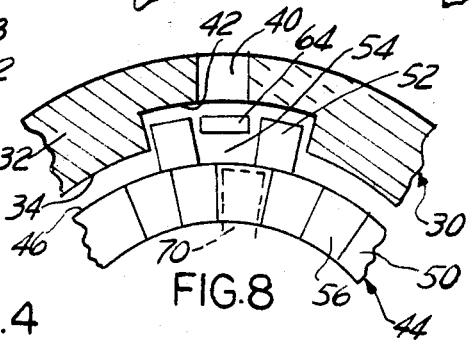
FIG. 8
FIG. 4
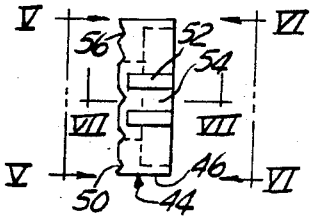
FIG. 5
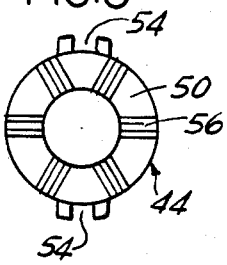
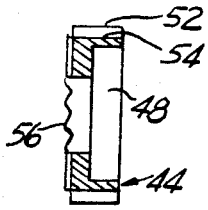
FIG. 7
FIG. 6
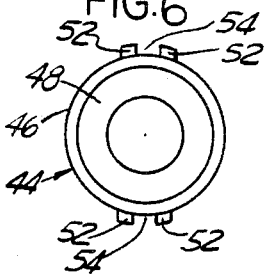
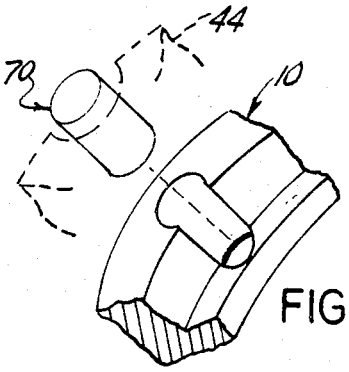
FIG. 9
FIG. 10
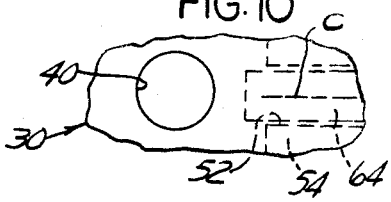
FIG. 11
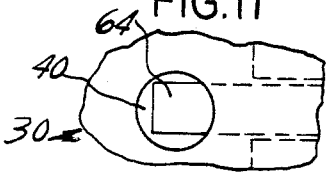

CONNECTOR ASSEMBLY AND COUPLING RING

This invention relates to a connector assembly including a pair of connector members and coupling ring with anti-decoupling means and visual, tactile, and audible indication of the mated condition of the connector members.

A plug and receptacle electrical connector assembly is connected by a coupling nut and restrained from uncoupling by ratchet means which operate between the coupling nut and the plug connector. When an operator proceeds to couple the connector parts, there is a possibility of interruption in the coupling process which will allow the connectors to be only partially coupled whereby the operator may get a false feeling that the coupling operation was complete. One example of such an interruption would be the unwanted presence of an obstructive material such as a metal chip in the coupling threads, or a slight dimensional discrepancy such as resulting from a mechanical shock, etc. Designs which provide a full-time ratcheting are effective but lead to unnecessary wear on the connector material and could contribute to introduction of the obstructive material.

Many attempts have been made to provide visual, audible and/or tactile means for indicating the mating condition of electrical connectors fiber optic connectors and the like. One of the problems in providing such indication is in the area of visual indication. Audible indicating means normally have no directional limitations as to the positioning of the connector in relation to the user. The same holds true for tactile means because the user can through some sort of manual manipulation determine the functional condition of the connector. Visual indicating means are typically limited by the direct observation of the individual.

In "Full Mate Indicator for Detachable Connectors" U.S. Pat. No. 4,289,368 issuing Sept. 5, 1981 to Schildkraut, full mating is visually indicated as a result of the starting end of the screw thread on the incoming receptacle causing an inwardly biased indicator on the coupling nut to be driven outwardly. Because the thread spirals axially rearward from the front face of the receptacle, even though the front face is still approaching the plug, the indicator will retreat and could give a false visual sense of mated condition. Other designs are provided with annular slots or windows in the coupling ring. Prior published U.S. Pat. No. 4,290,662 issuing Sept. 22, 1981 to Storcel is of interest in that the connector assembly is provided with visual, tactile and audible indication of full mate.

The present invention is directed to providing a connector assembly with anti-decoupling means for resisting unwanted disconnection of a pair of connector members from their mated relation, and indicating means providing a visual, audible and tactile signal representing the mated relation of a pair of connector members.

Another object of the invention is provision of audible and tactile mate indication which eliminates unnecessary wear on the coupling contact surface of the connector body material. Another object of the invention is provision of visual indication means operating with the anti-decoupling means to indicate the position of receptacle.

As disclosed in the present invention, a connector assembly includes a pair of connector members and coupling member rotatably mounted on one connector member for engaging with the other connector member to draw the two connector members together into a fully mated condition wherein electrical contacts or optical fibers are electrically or optically connected.

In accord with this invention, there is provided indicating means in conjunction with anti-decoupling ratchet means for simultaneously providing an audible, visual and tactile indication that the fully mated condition is being achieved and achieved. A coupling ring includes an opening extending therethrough and a keyway on its inner wall. A nested subassembly is disposed around the plug connector and coupled to the coupling ring and constrained for rotation therewith and axial movement thereto, the subassembly comprising a cylindrical cup-shaped detent sleeve having two keys extending radially outward from the outer periphery thereof with each including a longitudinal slot, a wave washer received in the cavity defined by the detent sleeve, and an indicator element comprising an annular actuator plate and a pair of indicator members extending perpendicuarly therefrom, each of the indicator members being slidably received within one respective slot for reciprocation from a first position concealed from view and to a second position visible through the opening and one key being received within the keyway within the coupling ring carried by the plug shell. The detent sleeve includes a plurality of detent grooves projecting longitudinally aftward from and around its end face for engaging a stop member extending from the plug shell configured to engage with the detent grooves.

One feature of the invention is a coupling arrangement which will resist unwanted uncoupling rotation of a coupling ring and provide a visual indication that a fully coupled position has been achieved. Another feature of the invention is to provide anti-decoupling means whose rotation resistance is normally inoperative but becomes operative and increases as the coupling process continues with the highest resistance being at the fully coupled position. Still another feature is provision of anti-decoupling ratchet means which does not operate when the connectors are being uncoupled from their completely coupled relation.

Other objects, features, and advantages of the invention will be readily apparent from the following detailed description taken in connection with the accompanying drawings, in which, FIG. 1 is a cross-section view of a mated plug and receptacle connector assembly.

FIG. 2 is a sectional view of a mated receptacle and plug connector member.

FIG. 3 of a portion of the plug connector.

FIG. 4 is a top view of a detent sleeve shown in FIG. 3.

FIG. 5 is a view taken along lines V—V of FIG. 4.

FIG. 6 is a front view of the detent sleeve taken along lines VI—VI of FIG. 4.

FIG. 7 is a sectional view of the detent sleeve taken along lines VII—VII of FIG. 4.

FIG. 8 is a view taken along lines VIII—VIII of FIG. 1.

FIG. 9 is a partial view showing interior detail of the plug shell and a stop member mounted therewithin.

FIG. 10 is a view showing an end portion of an indicator member in a concealed position.

FIG. 11 is a view of the indicator member moved to the unconcealed position.

FIG. 12 is a view of the ratchet detent grooves extending from the detent sleeve.

FIG. 13 is an alternate configuration of detent grooves.

Figure 1:
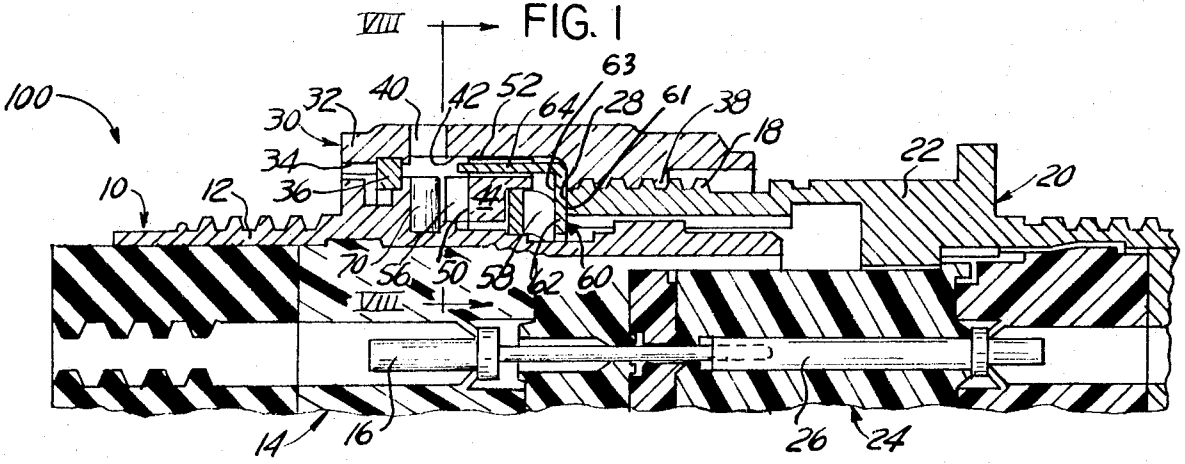

Referring now to the drawings in greater detail, FIG. 1 shows an electrical connector assembly, generally designated 100, nearing its fully mated condition. It should be understood that the invention is contemplated for a wide variety of applications such as in electrical connectors, fiber optic connectors, and the like.

The electrical connector assembly includes a first part or plug connector member 10, a second part or receptacle connector member 20, and a coupling member or ring 30 rotatably carried by the plug and connected to the receptacle, the connector members 10 and 20 having generally cylindrical shells 12, 22 configured for coaxial connection and the receptacle shell 22 and the coupling ring 30 having complementarily engageable thread 18, 38 for axially drawing the plug connector into mating engagement into the receptacle connector and an end face 28 of the receptacle into the coupling ring. The plug connector member 10 has an insert member 14 (as is known) in which is disposed one or more electrical contacts, such as the pin contact 16. The receptacle connector member 20 has thread 18 on the outer periphery of its shell and carries an insert member 24 in which is disposed one or more electrical contacts, such as the receptacle contact 26 for receiving the pin contacts 16. The insert members 14, 24 and the contacts 16, 26 are known and are not shown in further detail in the drawings so as to facilitate description of the anti-decoupling and mate indicating means described hereinafter.

Coupling ring 30 includes a generally cylindrical shell 32 having an interior wall 34 and is held in position on the plug connector 10 for rotation relative thereto by means of a retaining ring 36, the interior wall 34 including a longitudinal keyway 42 and the internal threads 38 which cooperate with the external threads 18 of the receptacle connector member 20 to draw the receptacle connector member and end face 28 thereof axially into the coupling ring and into mating relation with the plug connector member 10. Coupling direction rotation draws the respective contacts of the connector members into mating engagement, and, as described below, affects movement or actuation of the visual, tactile and audible indicating means and initiates interengagement of the anti-decoupling resisting means of the present invention.

A nested subassembly is disposed around the plug connector member 10 and coupled to the coupling ring 30, the nested assembly being constrained both for rotation with and axial movement relative to the coupling ring. The subassembly, although shown best in conjunction with FIG. 3, comprises a generally cylindrical, cup-shaped, detent sleeve 44 having on the outer periphery 46 thereof a pair of longitudinal keys 52 with each including a longitudinal slot 54, a wave washer 58 received in a cavity 48 defined by the sleeve, and an indicator element 60 comprising an annular actuator plate 62 and a pair of indicator members 64 extending perpendicularly therefrom with each indicator member being slidably received within one respective slot for longitudinal reciprocation therewithin. The actuator plate positions itself forward and rearward end faces 61, 63, respectively, so as to abut against the end face 28 of the receptacle member 20 and the waved washer 58.

Each of the keys 52 and a pair of longitudinal keyways 42 extend radially outward and radially inward, respectively, from the outer periphery 46 of the detent sleeve 44 and the interior wall 34 of the coupling ring 30, the keys being disposed in a respective keyway to constrain the detent sleeve 44 to rotate with the coupling ring during rotation and constrain the detent sleeve, wave washer 58 and indicator element 60 for axial movement relative to the plug connector 10 during final connection of the plug and receptacle connector shells. The keys, although shown as being comprised of a pair of longitudinally extending ribs the angular separation between which defines the slot 54, could comprise a single rib having a longitudinal groove formed therein. The longitudinal slot 54 allows the indicator members 64 to slidably move rearwardly therewithin from a first position to a second position. The rearward portion of the coupling ring includes an opening 40 which, because of the positioning of the key and keyway, is aligned with the slot 54 so that the indicator member 64 advances from the first position, concealed by the coupling ring, and to the second position and into the opening 40 for viewing.

A normally inoperative ratchet arrangement engageable between the plug connector member and the coupling member is adapted to engage and become operable only when the two connector parts approach their final mated condition by rotation of the coupling member in the mating direction. The ratchet arrangement retards rotation of the coupling ring relative to the plug connector and includes the transverse end face 50 of the detent sleeve 44 having a plurality of detent grooves such as ratchet teeth 56 being arranged therearound and being adapted to engage a stop member 70 extending from the plug connector.

Visual indicating means is provided and is associated with the coupling ring 30 and is moveable longitudinally relative thereto from a concealed position within the peripheral bounds of the coupling ring to a second, indicating position (FIG. 2) projecting into the opening 40 of the coupling ring in response to the aforesaid positioning of the connector member 20 within the coupling ring.

As is shown in FIG. 1, the receptacle connector member 20 has been threadably engaged with the coupling ring 30 and received within the plug connector member 10 and the front face 28 of the receptacle is abutting against the forward end face 61 of annular actuator plate 62 and driving the rearward end face 63 against the waved washer 58.

As a result of further rotation, the annular actuator plate is acted upon by the front face 28 of the advancing receptacle shell to longitudinally drive the indicator 60 element with its indicator members 64 against the waved washer, the waved washer rearwardly into compression against the detent sleeve, and the detent sleeve axially rearward, whereupon the detent grooves defining the ratchet teeth 56 engage with the stop member 70 extending from the plug connector. As this happens, the ratchet teeth start to engage with the stop member to audibly "click" and tactilely indicate rotation resistance. Further rotation drives the indicator members 64 from their normally concealed position in the coupling member to a position visible through the opening 40.

Figure 2:
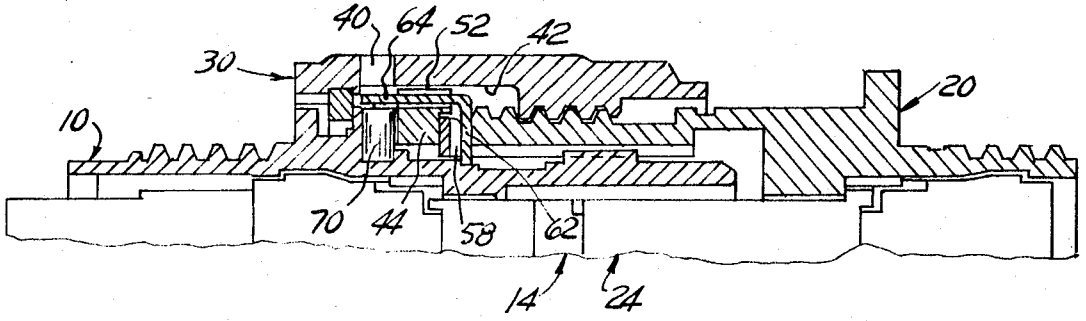

FIG. 2 shows a fully mated condition with the end face 28 of the receptacle 20 having forced the actuator plate 62 with indicator members 64 rearwardly until such point as the indicator member appears in the opening 40, the waved washer 58 compressed by the actuator plate within the cavity 48 of the detent sleeve, and the ratchet teeth biased into engagement with the stop member to resist relative rotation of the coupling nut.

FIG. 3 shows the nested subassembly mounted onto the plug connector member 10 with the stop member 70 extending from the plug connector engaging the ratchet teeth 56 extending longitudinally aftward from the end face 50 of the detent sleeve 44, a pair of longitudinal keys 52 extending radially outward from diametrical positions on the detent sleeve 44 and each having a longitudinal slot 54, the interior cavity 48 receiving the waved washer 58, and the actuator plate 62 having indicator members 64 extending perpendicularly from the outer rim 66 thereof for slidable receipt within the slots 54 provided by the keys 52. The phantom line shows reciprocation of the indicator member from a concealed first position to the second and visual indication position relative to the plug connector member.

To reduce wear on the connector body material, the stop member, separately manufactured, and the detent sleeve are comprised of a hardened metal. Although only one stop member is shown, a plurality could be fixedly disposed around the plug connector. the ratcheting resistance increases as the coupling process continues. The highest resistance is at the fully coupled position. When the connectors are completely decoupled, ratcheting discontinues and the coupling ring rotates freely on the plug.

FIG. 4 shows the detent sleeve 44, one of the two longitudinal keys 52 formed thereon and the slot 54.

FIG. 5 show end face 50 of the detent sleeve and the ratchet grooves 56 therearound.

FIG. 6 shows the front view of the detent sleeve 44 and the cavity 48 formed for receiving the waved washer.

FIG. 7 shows the detent sleeve in section and the cavity 48 for receiving the waved washer.

FIG. 8 shows a portion of end face 50 of the detent sleeve 44 with the ratchet teeth 56 therearound, the stop member 70 (shown in phantom) being received within one of the succession of ratchet teeth, the key 52 extending from the detent sleeve 44 being received in the keyway 42 of the coupling ring 30, and the indicator member 64 positioned within the slot 54. During movement of the indicator element 60 from the first to the second position the indicator member 64 moves perpendicularly to the plane of the paper.

FIG. 9 shows a fragment of the plug connector 10 with the stop member 70 being removed for assembly therewith. Although the stop member is shown as a generally cylindrical pin being radially fitted to the connector, other configurations are possible, depending on the detent grooves. The mounting of the stop member could dispose the pin so as to extend in the longitudinal direction.

FIG. 10 is a top view of a rearward portion of the coupling ring 30 outer periphery, such as would be seen in FIG. 1, showing the opening 40 and the indicator member 64 in phantom in its first position and concealed from view, the dashed arrow, designated as "C", indicating the direction of motion of the indicator member as a result of actuation by the receptacle member against the annular washer.

FIG. 11 shows the mated condition, such as would be seen in FIG. 2 looking down at the coupling ring, wherein the indicator member 64 appears in the opening 40.

FIG. 12 shows a profile of one of the ratchet teeth 56 formed on detent sleeve 44, the tooth having respective inclined portions indicated by "A" and "B" with "A" being more shallow than "B" to allow less rotation to resistance in the coupling direction and more resistance to rotation in the uncoupling direction.

FIG. 13 shows a V-shaped tooth having inclined faces "B" and "A".

To enhance visual indication of mated relation, the plug connector and the indicator member could be painted with different colors.

I claim:

1. A two-part electrical connector including a rotatable coupling member carried by one part for engaging the other part, comprising a detent sleeve carried by one part and coupled to said coupling member, normally inoperative ratchet means engageable between said one part and said detent sleeve for resisting rotation of the coupling member, said ratchet means being adapted to become operable only when the two parts approach a fully mated condition by rotation of the coupling member in a mating direction, and indicating means associated with the ratchet means for indicating that the fully mated condition exists, said detent sleeve including a key having a longitudinal slot, said coupling member includes an opening therethrough and a longitudinal keyway which receives the key, and said indicating means includes an indicator member that is slidably received in said slot for reciprocating from a first non-indicating position and concealed from the opening in the coupling member and to a second indicating position and visible through the opening.

2. In a connector assembly which includes first and second connector members adapted for mating engagement, a coupling member rotatably disposed on said first connector member for drawing the connector members into mating engagement, and indicating means associated with said coupling member and at least one of said connector members for movement between a first non-indicating position and a second indicating position in response to a predetermined positional relationship of said connector members, detent means associated with said indicating means and the one of said connector members for resisting rotation of the coupling member as a result of said indicating means being moved to the second indicating position, said detent means comprising a generally cylindrical detent sleeve coupled to said coupling member for rotation therewith and including on its outer periphery a key having a longitudinal slot, said coupling member including a cylindrical shell having an opening extending therethrough and a longitudinal keyway on the interior wall thereof receiving the key, and said indicator member is slidably received in said slot for reciprocating from the first non-indicating position and concealed from the opening and to the second indicating position and visible through the opening, said indicating means and detent means providing respectively a visual and an audible indication of the mating relation of the connector members.

3. The connector assembly of claim 2 wherein a plurality of detent grooves extend longitudinally from said detent sleeve, and a stop member extends from said first connector member for engaging and providing a ratcheting with said detent grooves.

4. The connector assembly of claim 3 wherein said indicating means comprises an actuator portion and an indicator member moveably supported by said coupling member for movement thereto, bias means associated with said detent sleeve for biasing against the actuator portion and the indicator member into the first non-indicating position, the actuator portion being carried by the one of said connector members and engaged by the other connector member when the members advance to their predetermined positional relation.

5. An electrical connector with rotation resisting and mated indicating means, comprising first and second shells adapted to be mated together, a coupling ring rotatably mounted on the first shell and engageable with the second shell for axially pulling the shells together upon rotation of the coupling ring in one direction to cause an end portion of the second shell to approach the first shell, resisting means for resisting rotation of the coupling ring in the other direction, and indicating means for indicating that the shells are mated, characterized in that said resisting means operate only near full mate and comprise said coupling ring including a keyway, a detent sleeve including a key having a longitudinal slot and disposed in said keyway, and a detent arrangement including a stop member and a plurality of detent grooves projecting respectively from one and the other said detent sleeve and said first shell with the stop member being adapted to interengage with respective of the detent grooves by rotation of the coupling ring, said indicating means comprising an indicator member disposed in said slot and adapted to be engaged by said end portion of the second shell and moved from a first to a second position indicating unmated and mated positions respectively of the shells, and bias means disposed in the detent sleeve for constantly biasing the indicator member oppositely of the detent sleeve and towards the first position.

6. The connector as recited in claim 5 characterized by constraining means operating between the coupling ring and the detent sleeve for constraining the detent sleeve to rotate with the coupling ring and to axially reciprocate relative thereto upon said indicator member being driven against the bias means and towards the second position.

7. An electrical connector as recited in claim 6 wherein said indicating means comprise an annular actuator plate having an outer rim and includes said indicator member extending perpendicularly rearward from the outer rim, the actuator plate having a rearward end face adapted to press against the bias means and a forward face adapted to be engaged by the end portion of the second shell.

8. An electrical connector as recited in claim 5 wherein said coupling ring includes an opening and said indicator member is concealed from said opening in the first position and is visible through the opening in the second position.

9. An electrical connector with rotation resisting and mated indicating means, comprising first and second shells adapted to be mated together, a coupling ring rotatably mounted on the first shell and engageable with the second shell for axially pulling the shells together upon rotation of the coupling ring in one direction to cause an end portion of the second shell to approach the first shell, resisting means for resisting rotation of the coupling ring in the other direction, and indicating means for indicating that the shells are mated, characterized in that said resisting means operate only near full mate and comprise a detent sleeve having an end face that extends radially inward from the outer periphery thereof to define a cup-shaped member, and a detent arrangement including a stop member and a plurality of detent grooves projecting respectively from one and the other said detent sleeve and said first shell with the stop member being adapted to interengage with respective of the detent grooves by rotation of the coupling ring, said detent grooves extending longitudinally aftward from the end face to engage the stop member extending from the first shell, said indicating means comprising an indicator member adapted to be engaged by said end portion and moved from a first to a second position indicating unmated and mated positions respectively of the shells, and bias means disposed in the cup-shaped member for constantly biasing the indicator member oppositely of the detent sleeve and towards the first position.

10. An electrical connector as recited in claim 9 wherein said stop member extends radially from said first shell and has a forward portion that extends longitudinally forward to engage successive of said detent grooves.

11. An electrical connector as recited in claim 9 wherein said coupling ring includes an opening and said indicator member is concealed from said opening in the first position and is visible through the opening in the second position.

* * * * *